US008484026B2

(12) United States Patent
Lin

(10) Patent No.: US 8,484,026 B2
(45) Date of Patent: Jul. 9, 2013

(54) PORTABLE AUDIO CONTROL SYSTEM AND AUDIO CONTROL DEVICE THEREOF

(76) Inventor: Pi-Fen Lin, Keelung (TW)

( * ) Notice: Subject to any disclaimer, the term of this patent is extended or adjusted under 35 U.S.C. 154(b) by 989 days.

(21) Appl. No.: 12/546,151

(22) Filed: Aug. 24, 2009

(65) Prior Publication Data

US 2011/0046954 A1 Feb. 24, 2011

(51) Int. Cl.

| | |
|---|---|
| ***G10L 13/00*** | (2006.01) |
| ***G10L 13/06*** | (2006.01) |
| ***G10L 21/00*** | (2006.01) |
| ***G10H 1/00*** | (2006.01) |
| ***G10H 7/00*** | (2006.01) |
| ***G10H 1/10*** | (2006.01) |
| ***G10H 1/26*** | (2006.01) |
| ***G10H 1/36*** | (2006.01) |

(52) U.S. Cl.

USPC ..... 704/258; 704/268; 704/260; 704/277; 84/600; 84/604; 84/631; 84/645; 84/649; 84/650

(58) Field of Classification Search

USPC ..... 704/258, 268, 260, 277; 84/600, 84/604, 631, 645, 649, 650

See application file for complete search history.

(56) References Cited

U.S. PATENT DOCUMENTS

| | | | | |
|---|---|---|---|---|
| 6,083,009 | A * | 7/2000 | Kim et al. | 434/307 A |
| 6,328,570 | B1 * | 12/2001 | Ng | 434/307 A |
| 6,931,377 | B1 * | 8/2005 | Seya | 704/277 |
| 7,119,267 | B2 * | 10/2006 | Hirade et al. | 84/602 |
| 2002/0189429 | A1 * | 12/2002 | Qian et al. | 84/610 |
| 2003/0012361 | A1 * | 1/2003 | Yoshimura | 379/373.01 |
| 2003/0104785 | A1 * | 6/2003 | Iwanaga | 455/66 |
| 2005/0255914 | A1 * | 11/2005 | McHale et al. | 463/31 |
| 2006/0062400 | A1 * | 3/2006 | Chia-Chun | 381/74 |
| 2008/0184870 | A1 * | 8/2008 | Toivola | 84/610 |
| 2009/0165634 | A1 * | 7/2009 | Mahowald | 84/610 |
| 2010/0203491 | A1 * | 8/2010 | Yoon | 434/307 A |

* cited by examiner

*Primary Examiner* — Edgar Guerra-Erazo
(74) *Attorney, Agent, or Firm* — Houtteman Law LLC

(57) ABSTRACT

A portable audio control system that controls an audio signal transmitted from an electronic device, including an earphone device and an audio control device. The audio control device includes an audio source receiver, a signal synthesis module, and an audio output unit. The audio receiver, which is connected with the electronic device, is used for receiving the audio signal. The signal synthesis module receives both the audio signal and a voice signal coming from an external audio resource, and then synthesizes those signals. The audio transmitter is used to output the synthesized sound to the earphone device. As users utilize the portable audio control system to connect with the electronic device, both sound from the electronic device and the external voice or song can be listened at the same time.

17 Claims, 6 Drawing Sheets

PORTABLE AUDIO CONTROL SYSTEM AND AUDIO CONTROL DEVICE THEREOF

BACKGROUND OF THE INVENTION

1. Field of the Invention

The present invention generally relates to a portable audio control system and an audio control device thereof, more particularly to the system used for controlling the sounds from different resources.

2. Description of Related Art

There are many electronic products providing function of playing music currently, especially from the conventional CD player, the popular music cellular phone to the MP3 or MP4 player. People are already used to listen to music using an earphone coupled to the playing device. Especially to the lovers of music, the modern music players are provided for listening and practice anywhere and anytime.

However, only the music can be heard via the earphone when the user uses the player to practice singing. As singing follows the music, the voice made by the user will be propagated to himself via air. Additionally, since the conventional earphone also separates the outside sound, it's difficult for the user himself to discern whether the singing and rhythm match the music.

In an exemplary example, when the user desires to listen to the music accompaniment and practice singing at the same time, additional computer equipment and the related software are required to process the relevant configuration. Actually, the conventional way is unfriendly for a computer-beginner to configure input/output of the music. More, it's not convenient to bring the computer during the outdoor activities or on the way by car, even though it is a suitable time to conduct practice.

According to the above description, a specific technology is required to provide the user to hear his voice or singing as listening to the music. This kind of technology may increase the amusement and enhance the singing practice.

SUMMARY OF THE INVENTION

One of the embodiments of the present invention is to provide an audio control device that is used to control the audio signals issued by an earphone device and an electronic device. The audio control device preferably includes an audio receiver, a sound synthesis module, and an audio output unit. The audio receiver is used to receive the audio signals from the electronic device. The sound synthesis module receives the audio signals and voice signals sourced from outside the sound control device, and synthesizes them to a synthesis sound. The synthesized sound can be outputted to the earphone device via the audio output unit. By synthesizing the signals, both the audio produced by the electronic device and the outside voice can be heard via the earphone device at the same time.

According to one embodiment of the present invention, provided is a portable audio control system. The system can control the audio signals issued from the electronic device. The portable audio control system preferably includes an earphone device and an audio control device. The audio control device further has an audio receiver, sound synthesis module, and an audio output unit. The audio receiver is selectively coupled to the electronic device, and used for receiving the audio signals. The sound synthesis module receives the voice signal from outside the audio control device and the audio signal received from the audio receiver, and synthesizes the audio signal and the voice signal to a synthesis sound. The audio output unit is to output the synthesis sound to the earphone device. Users can use the portable audio control system to listen to both the audio signal issued from the electronic device and the voice from outside.

The portable audio control system and the device disclosed in the present invention allow users to connect any electronic device made for playing sound. When a user uses the earphone device to listen to the sound from the electronic device, another sound from difference source can be heard simultaneously. For example, a music player is connected for the user to listen to both background music and the voice made by the user. Another example is to connect to a language learning machine, and a learner can listen to a teacher's pronunciation and the learner's practice at the same time. Furthermore, the components of the claimed portable audio control system can be parted for storage when it is unused.

BRIEF DESCRIPTION OF THEE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE PREFERRED EMBODIMENTS

For further understanding of the invention, please refer to the following detailed description illustrating the embodiments and examples of the invention. The description is only for illustrating the invention and is not intended to be considered limiting the scope of the claim.

Figure 1:
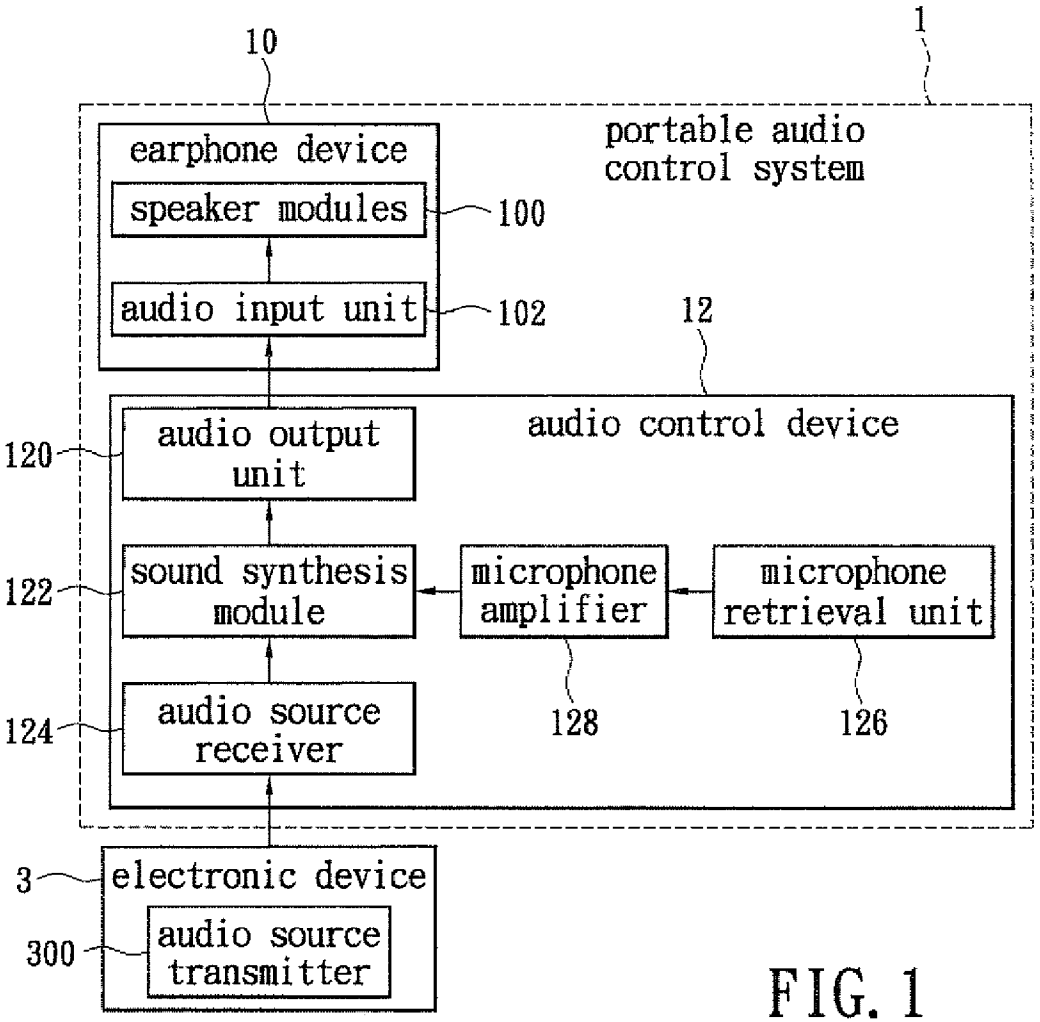
FIG. 1 shows a block diagram of the first embodiment of the portable audio control system of the present invention.

Reference is made to FIG. 1 showing a block diagram of a first embodiment of the portable audio control system. The claimed portable audio control system 1 preferably has an earphone device 10 and an audio control device 12. The portable audio control system 1 is used to control the audio signals issued from an electronic device 3. In particular, the audio signals and the outside voice signals are processed through the audio control device 12 and outputted to the earphone device 10.

The mentioned electronic device 1 particularly includes an audio source transmitter 300. Generally, the electronic device 3, such as a conventional MP3/MP4 music player, a music mobile phone, a language learning machine, an electronic dictionary, or a host computer, can issue music, song wordbook pronunciation, and the analogous audio signals. In which, the audio source transmitter 300 is used to transmit the audio signals. In the current preferred embodiment, the electronic device 3 preferably produces a stereo sound.

The mentioned audio control device 12 at least includes an audio output unit 120, a sound synthesis module 122, an audio source receiver 124, a microphone retrieval unit 126, and a microphone amplifier 128. The audio source receiver 124 can be selectively coupled to the audio source transmitter 300 of the electronic device 3. At present, the audio source receiver 124 receives the audio signals issued from the electronic device 3 when the audio source transmitter 300 is connected. Such as a music player that can continuously issue the song signals.

Figure 2:
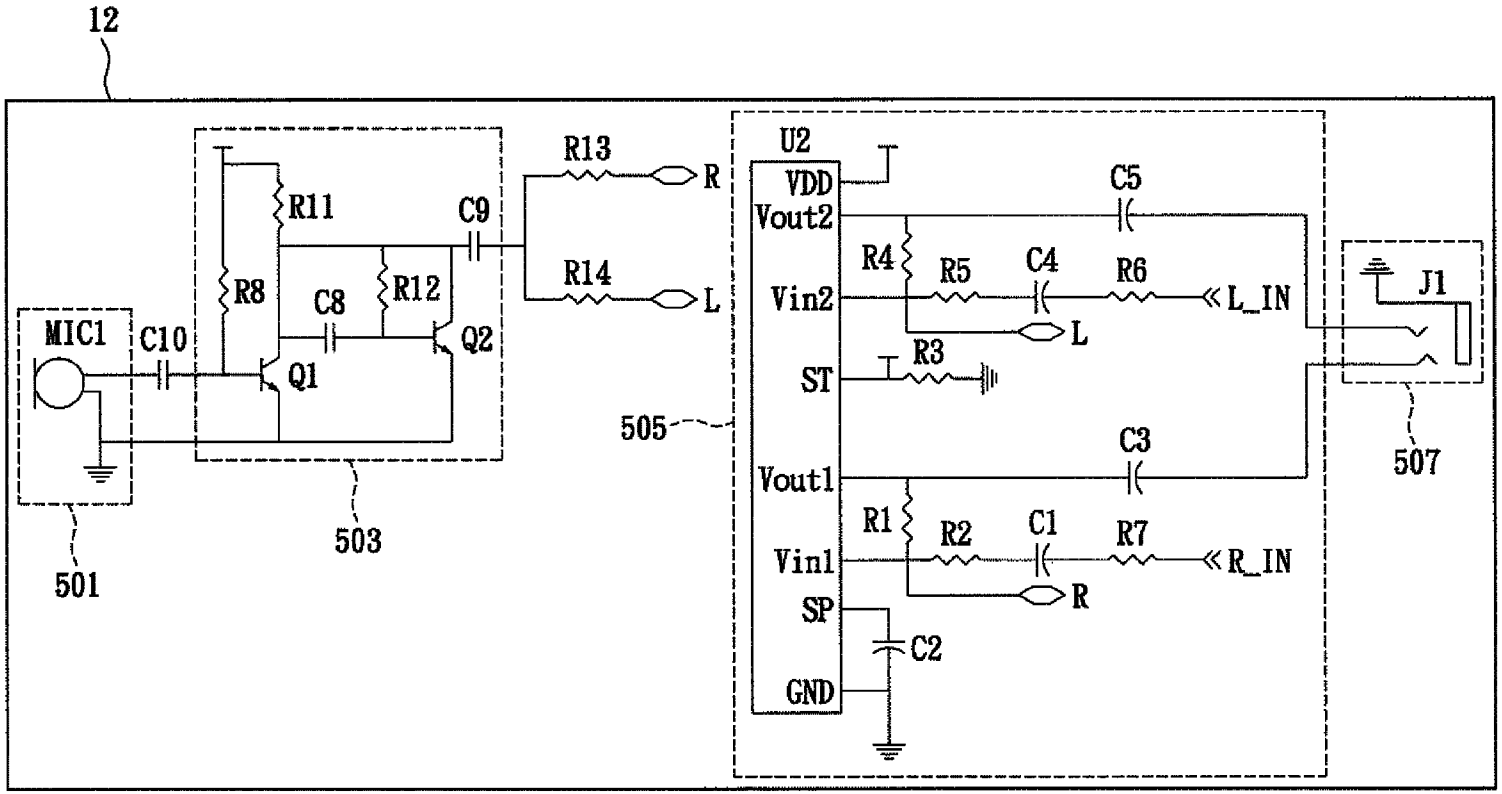
FIG. 2 is a circuit diagram of the audio control device of the first embodiment of the present invention.

Referring to FIG. 1 and further in view of FIG. 2, which shows a circuit diagram of the audio control device 12. A microphone retrieval unit 126, further referring to the element 501 in FIG. 2, retrieves the voice signals from outside the audio control device 12. The voice signal can be a user's speaking or song singing, and the retrieval signal is amplified through the microphone amplifier 128, further referring to the element 503 in FIG. 2.

More particularly, both the audio signals and the voice signals are transmitted to the sound synthesis module 122, further referring to the element 505 in FIG. 2, for synthesizing the signals thereby. The sound synthesis module 122, the audio source receiver 124, and the microphone amplifier 128 are electrically interconnected, in order to receive the sound signals from various resources simultaneously and continuously. After that, those signals are synthesized as synthesis sound.

In particular, the synthesis sound includes the audio signals sourced from the electronic device 3 and the voice signals sourced from outside via the microphone retrieval unit 126. In an exemplary example, the synthesis sound can include both the music from a music player and a singer's voice. The synthesis sound is then outputted to the earphone device 10 through the audio output unit 120, such as the element 507 shown in FIG. 2.

The earphone device 10 has a speaker module 100 and an audio input unit 102. The module 100 and the unit 102 are interconnected electrically. The audio input unit 102 receives the signals transmitted to earphone device 10, and the signals are the synthesis sound outputted from the audio output unit 120 of the audio control device 12. The audio input unit 102 then transmits the synthesis sound to the speaker module 100 for outputting. The speaker module 100 preferably has two speakers (not shown) for the user wearing a headset with a left earpiece and a right earpiece in order to output the stereo audio.

In which, the audio output unit 120 of the audio control device 12 and the audio input unit 102 of the earphone device 10 are selectively coupled. The combination of the units 102, 102 is used to transmit the synthesis sound.

According to the preferred embodiment of the present invention, the sound synthesis module 122 is preferably used to interconnect with the circuits of the audio source receiver 124 and the microphone amplifier 128. Further, the sound synthesis module 122 is then electrically connected to an operational amplifier IC. The audio signals and the voice signals are mixed by the interconnection of the circuits, and are amplified by the amplifier circuit, so as to produce the synthesis sound. Particularly, the operational amplifier IC can proportionally amplify the audio signals and the voice signals synthesized in the synthesis sound. In the current embodiment, the stereo audio includes the signals from a left channel and a right channel respectively. After mixing the audio signals and the voice signals, the synthesis sound reasonably has a signal from the left channel and the other signal from the right channel. After that, the sound synthesis module 122 simultaneously outputs the signals separately from the left channel and the right channel. When the signals are transmitted to the earphone device 10, the two speakers of the speaker module 100 respectively output the stereo sound.

Figure 3:
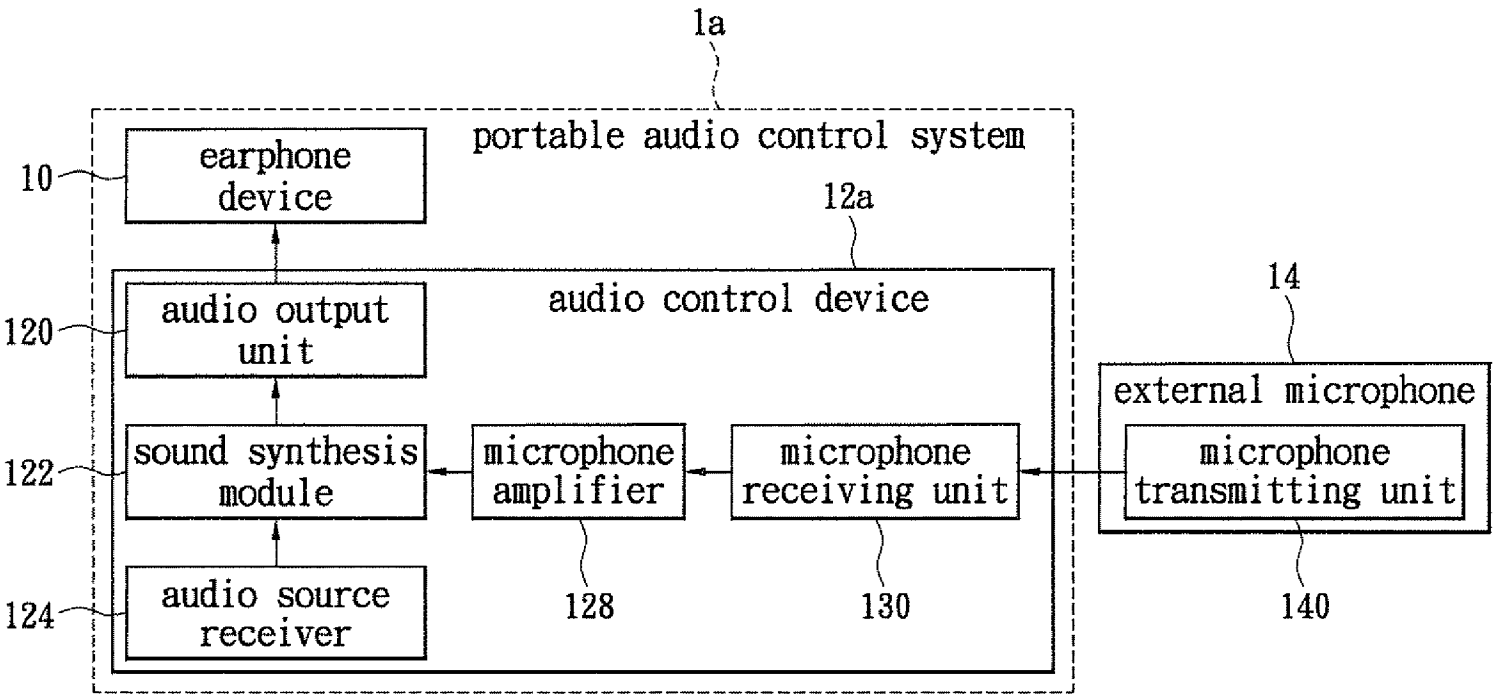
FIG. 3 shows a block diagram of the second embodiment of the portable audio control system of the present invention.

Reference is made to FIG. 3 shows a block diagram of the second embodiment of the portable audio control system of the present invention. It is noted that the difference from the first embodiment is that the portable audio control system 1*a* includes an external microphone 14 substituting for the microphone retrieval unit of first embodiment. The external microphone 14 is used to retrieve the voice signal and transmit to an audio control device 12*a*. The external microphone 14 particularly includes a microphone transmitting unit 140. Besides the elements disclosed in the first embodiment, the audio control device 12*a* further has a microphone receiving unit 140 electrically connected to the microphone amplifier 128.

The mentioned microphone transmitting unit 140 and the microphone receiving unit 130 are selectively connected. When these two units 130, 140 are interconnected, the external microphone 14 connects to the audio control device 12*a*. In the meantime, the voice signals retrieved by the external microphone 14 can be amplified by the microphone amplifier 128, and transmitted to the sound synthesis module 122 for further synthesizing. The other analogous operations can be referred to the first embodiment.

Figure 4:
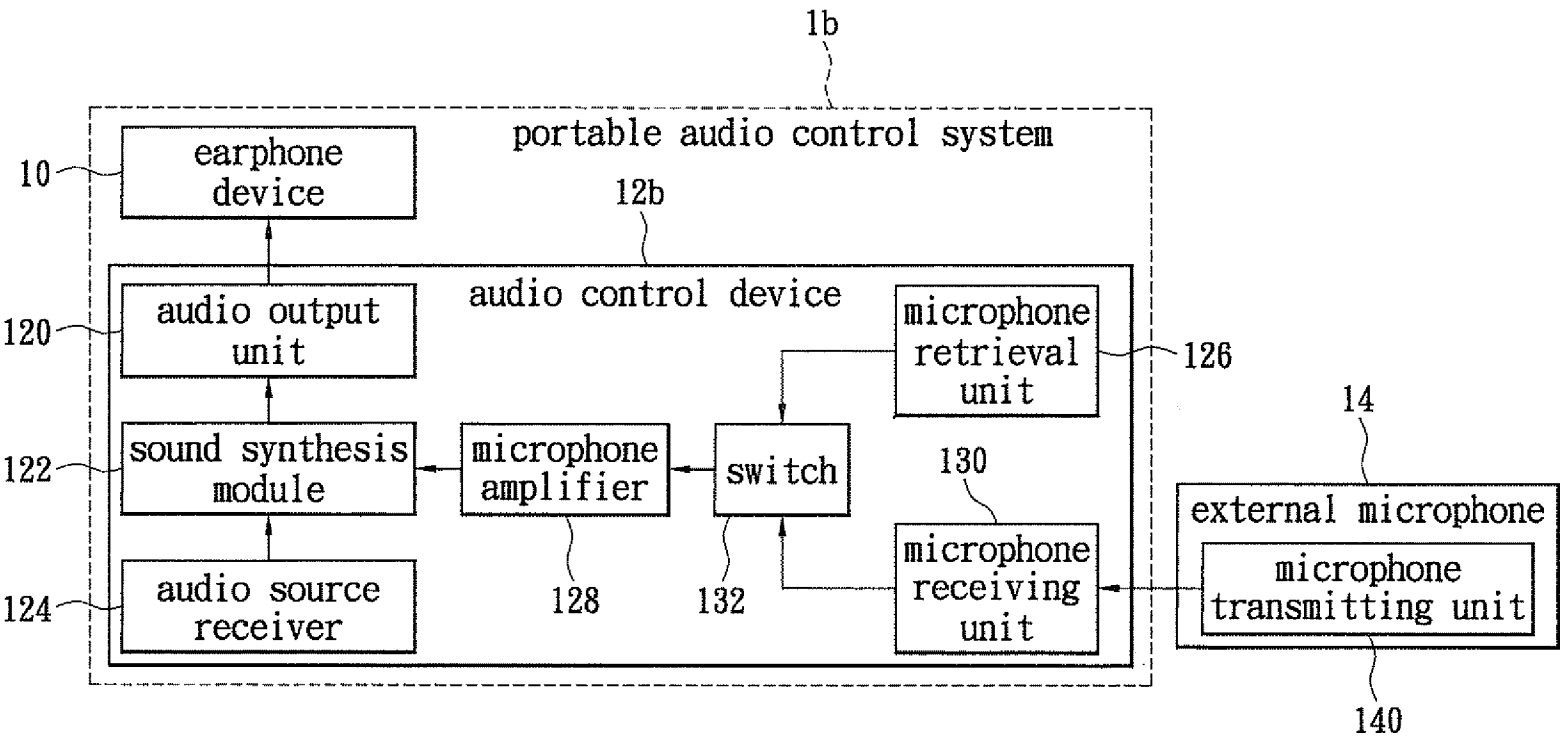
FIG. 4 shows a block diagram of the third embodiment of the portable audio control system of the present invention.

FIG. 4 shows a block diagram of the third embodiment of the portable audio control system of the present invention. An audio control device 12*b* of the third embodiment includes a switch 132 electrically connected to an intermediate portion among the microphone receiving unit 126, the external microphone 14, and the microphone amplifier 128. The embodiment integrates a built-in microphone retrieval unit 126 and an external microphone 14, and the user may select one route made by the unit 126 or the external microphone 14 to retrieve the voice signals. A switch 132 is preferably provided as a mechanical switch. The switch 132 is used to switch the route for transmitting the retrieved voice signals to the audio control device 12*b* since a microphone transmitting unit 140 of the external microphone 14 is connected with a microphone receiving unit 130.

On the contrary, when the external microphone 14 is not connected to the audio control device 12*b*, the microphone retrieval unit 126 is still used to retrieve the outside voice signals. The other analogous operations can be referred to the first and second embodiments.

Such as the above-described embodiments, the intermediate portion between the audio source transmitter 300 and the audio source receiver 124, the intermediate portion between the audio output unit 120 and the audio input unit 102, and the intermediate portion between the microphone transmitting unit 140 and the microphone receiving unit 130 can be selectively interconnected. The interconnecting means can be implemented as a wired connection made by the corresponding audio ports. For example, both the microphone transmitting unit 140 and the microphone receiving unit 130 can be the audio ports. One of the ports can be an audio jack, the other one can be an audio plug. When the audio plug inserts the audio jack, the external microphone 14 is electrically connected to the audio control device 12*b*. One of the embodiments can be referred to FIG. 5.

Figure 5:
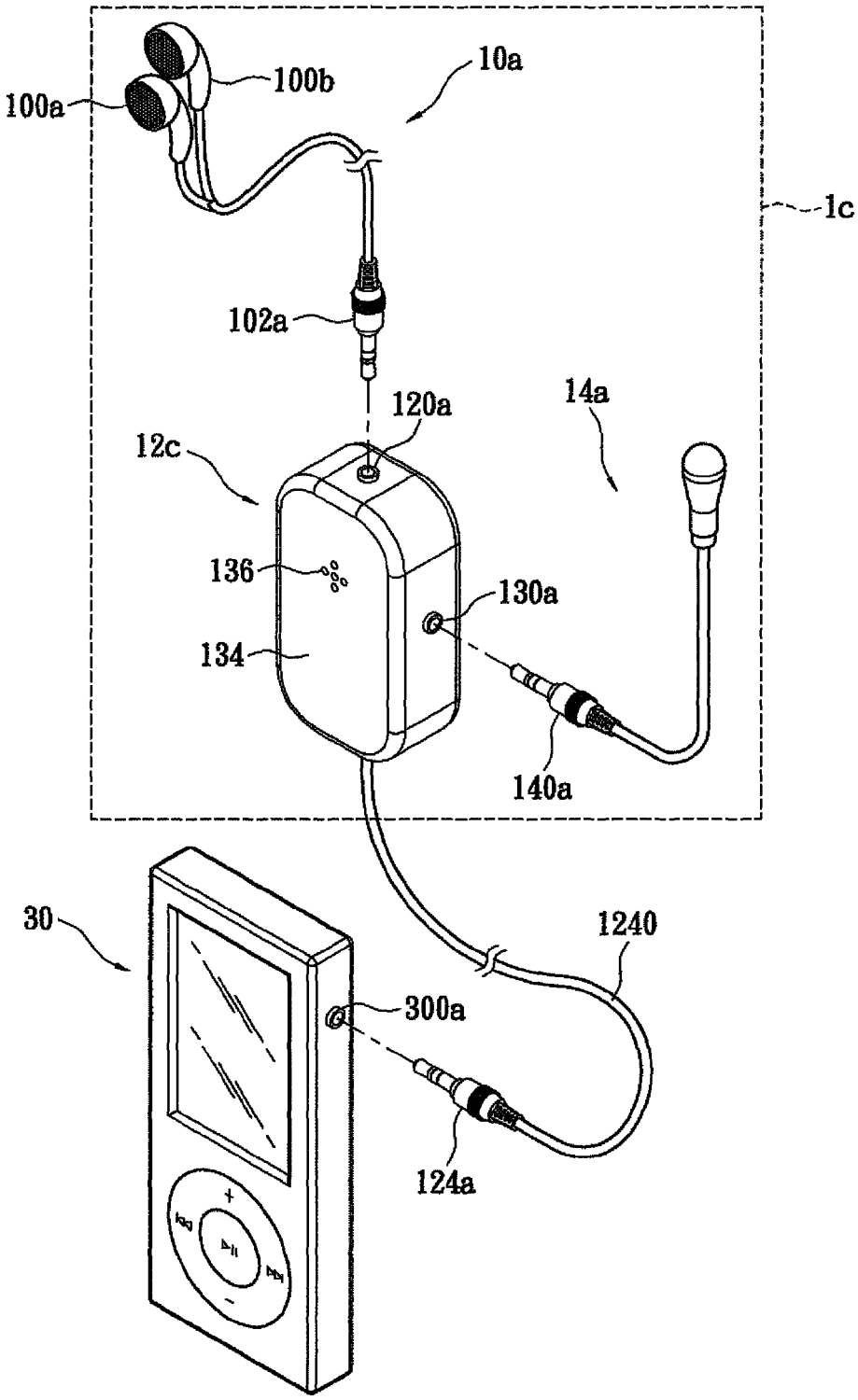
FIG. 5 is a schematic diagram of the fourth embodiment of the portable audio control system of the present invention.

Reference is made to FIG. 5 illustrating a fourth embodiment of the claimed portable audio control system. The portable audio control system 1*c* of the embodiment receives the audio signals issued from the music player 30. The portable audio control system 1*c* includes an earphone device 10*a*, an audio control device 12*c*, and an external microphone 14*a*. In which, the earphone device 10*a* preferably has two speakers 100*a*, 100*b* that can be used to receive the stereo synthesis sound. All the audio input unit 102*a* of the earphone device 10*a*, the audio source receiver 124*a* of the audio control device 12*c*, and the microphone transmitting unit 140*a* of the external microphone 14*a* are the mentioned audio plugs. More, all the audio output unit 120*a* and the microphone receiving unit 130*a* of the audio control device 12*c*, and the audio source transmitter 300 of the music player 30 are the mentioned audio jacks. The mentioned audio jacks and the audio plugs are wiredly and electrically connected for transmitting signals.

The advantages of the wired connection are that the audio plugs can be unplugged from the audio jacks when the music player 30 and the portable audio control system 1*c* are unused. More, it is convenient to pack up and replace the articles when the earphone device 10*a*, the audio control device 12*c*, the external microphone 14*a*, and the music player 30 are separated.

A housing 134 and a sound jack 136 are preferably equipped with the audio control device 12*c* of the current embodiment. An audio output unit 120*a*, a microphone receiving unit 130*a*, and the sound jack 136 are particularly disposed on the surface of the housing 134. More, an audio source receiver 124*a*, preferably is an audio jack, which stretches from the housing 134 of the audio control device 12*c* via a signal connector 1240. This audio jack is used for electrically plugging an audio source transmitter 300*a* of the music player 30. Furthermore, the microphone retrieval unit, microphone amplifier, and the sound synthesis module (not shown in this diagram) are installed in the housing 134. The microphone retrieval unit is positioned under the sound jack 136. Then the microphone retrieval unit (126) can retrieve the outside voice signals via the sound jack 136 when the external microphone 14*a* does not connect with the audio control device 12*c*.

Even though the above description shows the embodiment with wiredly connection as the audio port, but there is no limit to the portable audio control system utilizing the connection with the various devices or elements. Instead, the manufacturer may provide the various implements on the connection based on the clients' requirements.

Figure 6:
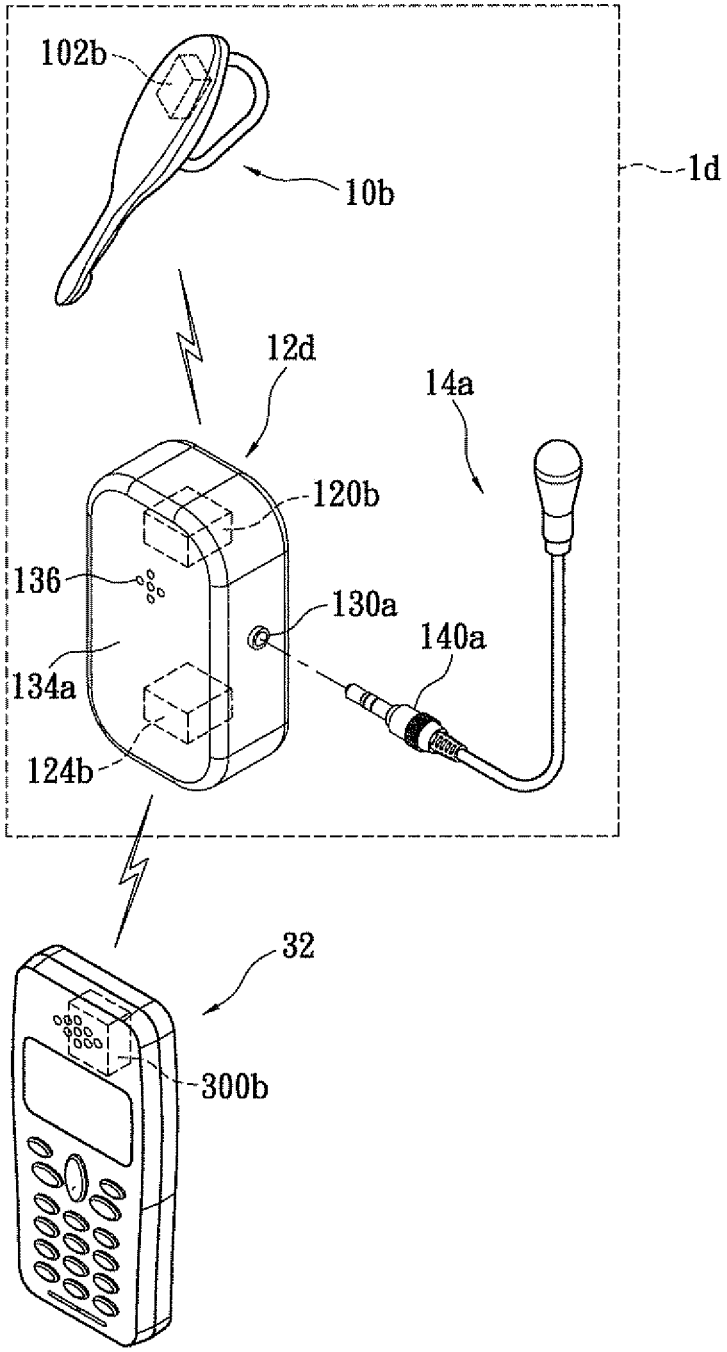
FIG. 6 shows a schematic diagram of the fifth embodiment of the portable audio control system of the present invention.

FIG. 6 shows the fifth embodiment of the claimed portable audio control system. The shown portable audio control system 1*d* and the music mobile phone 32 are wirelessly connected. The earphone device 10*b* is preferably a Bluetooth device, and its audio input unit 102*b* is compliance with the Bluetooth standard with a microphone and support for the Headset (LSP) and Hands-Free (HFP). The audio source transmitter 300*b* of the music mobile phone 32 is preferably a Bluetooth communication unit supporting the A2DP—Advanced Audio Distribution Profile. Further, the audio output unit 120*b*, the audio source receiver 124*b*, and other peripherals of the audio control device 12*d* are installed in the housing 134*a*. Both the unit 120*b* and the receiver 124*b* are the wireless communication unit supporting the Bluetooth communication, especially implemented as an earphone device 10*b* and a music mobile phone 32 respectively. In the recent case, the related Bluetooth devices can implement the multi-pairing, so that the audio control device 12*d* can simultaneously wireless-connect with the other various devices.

The built-in microphone retrieval unit (not shown in this diagram) is also installed in the housing 134*a*. Via the sound jack 136 on the surface of housing 134*a*, the microphone retrieval unit can retrieve the outside voice signals. In an example, the external microphone 14*a* is selectively switched to retrieve the voice signals when the microphone transmitting unit 140*a* and the microphone receiving unit 130*a* are electrically connected. The switching operation between the microphone retrieval unit and the external microphone 14*a* can be referred to the third embodiment of the present invention.

When the music mobile phone 32 and the audio control device 12*d* are wirelessly connected through the Bluetooth pairing, and the audio control device 12*d* and the earphone device 10*b* are also wireless paired, the audio control device 12*d* can accordingly receive the audio signals transmitted from the music mobile phone 32. Moreover, the voice signals, such as the user's singing, can be retrieved by the microphone retrieval unit or the external microphone 14*a*, and simultaneously being synthesized with the above-described audio signals. The synthesized sound is then transmitted to the earphone device 10*b* for the user listening to both background music and his own voice.

The described wireless connection shown in the fifth embodiment further includes Infrared ray, Radio frequency, and the like, other than the Bluetooth communication.

Moreover, the skilled person in the art can follow the descriptions in the fourth and fifth embodiments and modify the implements of the connection between the audio source transmitter 300 and the audio source receiver 124, or between the audio output unit 120 and the audio input unit 102, or between the microphone transmitting unit 140 and the microphone receiving unit 130. For example, it embodies a wireless communication between an electronic device and an audio control device, or a wired connection between an earphone device and an audio control device.

According to the above-described embodiments, there is a sound synthesis module 122 installed in the audio control device 12, which can synthesize the signals from various audio sources. The synthesized sound is then outputted through the speaker module 100 of the earphone device 10. The user, consequently, can hear the sound both from the electronic device 3 and from the microphone retrieval unit 126 through the earphone device 10.

According to an exemplary example, the user may listen to the music from the music player 30 or the music mobile phone 32 via the earphone device 10, meanwhile, his own singing through the microphone retrieval unit 126 or the external microphone 14 can be heard. Through the technology of the present invention, the user can sing accompanied with the music, and simultaneously hear both signals.

Since the audio control device 12 achieves the synthesis of the sound, users may utilize any earphone device and electronic device, or even any external microphone to connect to the claimed audio control device with the compatible connection format or the same wireless communication protocol. Accordingly, the user can carry the device easily, and practice singing anytime without any further configuration or modification. It's noted that it is extreme easy to exchange the earphone device (10) or the external microphone (14).

Furthermore, it is featured that the user may also exchange the electronic device (3) anytime. For example, since user may unplug the audio plug between the audio control device and the music player, or stop the wireless connection therebetween, and then exchange the audio control device to connect with the music mobile phone, he can listen to the various songs stored in either the music player or the music mobile phone.

Still Further, since the devices in the claimed portable audio control system can be selectively connected or unconnected, it is very convenient for the users packing up the portable audio control system by interrupting the connections between the earphone device, the audio control device, and the external microphone.

The above-mentioned descriptions represent merely the preferred embodiment of the present invention, without any intention to limit the scope of the present invention thereto. Various equivalent changes, alternations or modifications based on the claims of present invention are all consequently viewed as being embraced by the scope of the present invention.

What is claimed is:

1. An audio control device, used for enabling an electronic device to issue an audio signal and output sound to an earphone device, comprising:

an audio source receiver, selectively coupled with the electronic device, used for receiving the audio signal from the electronic device;

a sound synthesis module, used for receiving a voice signal from outside the audio control device, and the audio signal received by the audio source receiver, wherein the audio signal and the voice are synthesized as a synthesis sound;

an audio transmitter, used for outputting the synthesis sound to the earphone device;

a microphone retrieval unit, used for retrieving the voice signal;

a microphone receiving unit, electrically connected to an external microphone, for receiving the voice signal retrieved by the external microphone; and a switch, electrically connected to the microphone retrieval unit and the microphone receiving unit, wherein one of the microphone retrieval unit and the microphone receiving unit is selected by the switch for retrieving the voice signal.

2. The device of claim 1, further comprising:

a microphone amplifier, electrically connected to a midst of the switch and the sound synthesis module for amplifying the voice signal.

3. The device of claim 2, further comprising:

a housing, in which the sound synthesis module, the microphone retrieval unit, the switch, and the microphone amplifier are disposed; and a sound jack, disposed on a housing surface and connected to the microphone retrieval unit, for providing microphone retrieval unit to retrieve the voice signal.

4. The device of claim 1, wherein the audio source receiver is an audio connection port used for electrically connected to a corresponding audio connection port of the electronic device.

5. The device of claim 1, wherein the audio source receiver is a wireless communication unit, for wirelessly receiving the audio signal.

6. The device of claim 1, wherein the audio transmitter is an audio connection port electrically connected to a corresponding audio connection port of the earphone device.

7. The device of claim 1, wherein the audio transmitter is a wireless communication unit, for wirelessly outputting the synthesis sound.

8. A portable audio control system used for controlling an audio signal issued from an electronic device, comprising:

an earphone device; and an audio control device, comprising:

an audio source receiver selectively coupled with the electronic device, used for receiving the audio signal;

a sound synthesis module for receiving a voice signal and the audio signal received by the audio receiver, and synthesizing the audio signal and the voice signal as a synthesis sound; and an audio output unit for outputting the synthesis sound to the earphone device;

a microphone retrieval unit, used for retrieving the voice signal outside the audio control device, and transmitting the voice signal to the audio synthesis module;

a microphone receiving unit, electrically connected to an external microphone, for receiving the voice signal retrieved by the external microphone; and a switch, electrically connected to the microphone retrieval unit and the microphone receiving unit, wherein one of the microphone retrieval unit and the microphone receiving unit is selected by the switch for retrieving the voice signal.

9. The system of claim 8, wherein the external microphone having a microphone transmitting unit, used for retrieving the voice signal and transmitting the voice signal to the audio control device via the microphone transmitter.

10. The system of claim 9, wherein the microphone receiving unit selectively coupled with the microphone transmitting unit, used for retrieving the voice signal outside the audio control device;

wherein the microphone retrieval unit retrieves the voice signal from the external microphone as the microphone receiver connects to the microphone transmitter.

11. The system of claim 8, wherein the earphone device further comprising:

a speaker module used for outputting the synthesis sound; and an audio input unit selectively coupled with the audio output unit, for transmitting the synthesis sound to the speaker module.

12. The system of claim 11, wherein audio output unit is an audio connection port, and the audio input unit is a corresponding audio connection port of the audio output unit.

13. The system of claim 11, wherein both the audio output unit and the audio input unit are implemented as a wireless communication unit, and respectively outputting and inputting the synthesis sound wirelessly.

14. The system of claim 11, wherein the audio input unit transmits the synthesis sound to the audio input unit as the audio output unit connects to the audio input unit.

15. The system of claim 8, wherein the audio source receiver receives the audio signal as the audio receiver couples to the electronic device.

16. The system of claim 15, wherein the audio source receiver is an audio connection port used for electrically connecting with a corresponding audio connection port of the electronic device.

17. The system of claim 15, wherein the audio source receiver is a wireless communication unit, used for wirelessly receiving the audio signal.

* * * * *